United States Patent [19]

Diard et al.

[11] Patent Number: 5,064,214

[45] **Date of Patent: * Nov. 12, 1991**

[54] CROSS-COUNTRY SKI

[75] Inventors: Jean-Luc Diard; Philippe Grandjacques; Gilles Recher, all of Annecy, France

[73] Assignee: Salomon S.A., Annecy, France

[ * ] Notice: The portion of the term of this patent subsequent to Mar. 27, 2007 has been disclaimed.

[21] Appl. No.: 275,138

[22] PCT Filed: Feb. 4, 1988

[86] PCT No.: PCT/FR88/00060

§ 371 Date: Oct. 5, 1988

§ 102(e) Date: Oct. 5, 1988

[87] PCT Pub. No.: WO88/05675

PCT Pub. Date: Aug. 11, 1988

[30] Foreign Application Priority Data

Feb. 5, 1987 [FR] France ..... 87 01420

[51] Int. Cl.[5] ..... A63C 5/04

[52] U.S. Cl. ..... 280/607; 280/609; 280/615; 280/636

[58] Field of Search ..... 280/609, 607, 610, 615, 280/636

[56] References Cited

U.S. PATENT DOCUMENTS

| | | | |
|---|---|---|---|
| 4,094,528 | 6/1978 | Cluzel | 280/610 |
| 4,353,576 | 10/1982 | Salomon | 280/615 |
| 4,714,267 | 12/1987 | Abondance et al. | 280/615 |
| 4,789,177 | 12/1988 | Graillat | 280/607 |
| 4,911,462 | 3/1990 | Diard et al. | 280/607 |

FOREIGN PATENT DOCUMENTS

| | | | |
|---|---|---|---|
| 682623 | 9/1939 | Fed. Rep. of Germany | 280/609 |
| 3518457 | 12/1985 | Fed. Rep. of Germany | 280/615 |
| 2483240 | 12/1981 | France | 280/615 |
| 2572944 | 5/1986 | France | 280/615 |
| 61664 | 10/1939 | Norway | 280/610 |
| 68226 | 4/1929 | Switzerland | 280/610 |
| 152918 | 6/1932 | Switzerland | 280/610 |
| 248512 | 5/1947 | Switzerland | 280/609 |

*Primary Examiner*—David M. Mitchell

*Attorney, Agent, or Firm*—Sandler, Greenblum, & Bernstein

[57] ABSTRACT

A cross-country ski having an upwardly projecting longitudinal rib which laterally guides the shoe of the skier. For modifying its performance characteristics, the ski includes, on either side of the longitudinal rib, an auxiliary separate profile which is arranged to at least support the sole of the shoe. The separate profiles are affixed to the side surfaces of the rib.

17 Claims, 2 Drawing Sheets

1
1a
1b
2
2a
2b
2c
2d
2e
3
4
4a
4b
4c
4e
5
6
7
h
p
II

CROSS-COUNTRY SKI

BACKGROUND OF THE INVENTION

1. Field of the Invention

The present invention relates to a ski for cross-country skiing comprising a longitudinal rib projecting with respect to its top face.

2. Discussion of Background Information

Cross-country skis are already known which comprise a longitudinal rib on their top face. This longitudinal rib generally presents a trapezoidal cross section, in other words it is defined by a horizontal upper face and two inclined lateral faces and this rib of trapezoidal cross section joins the lower part of the ski which presents a rectangular cross section, of small height, of which the small sides constitute the edges of the ski. Due to the reduced height of these edges, such a cross-country ski slides more easily over the snow. Furthermore, the upper longitudinal rib contributes to the lateral guiding of the shoe mounted on the cross-country ski which is adapted to that end, due to the provision, in the sole, of a groove presenting in cross section a shape complementary of that of the rib of the ski.

SUMMARY OF THE INVENTION

The present invention relates to improvements in such a cross-country ski for the purpose of easily adapting its rigidity or its elastic response and of improving its technique, without notably increasing its weight.

To that end, this cross-country ski, comprising a longitudinal rib in its top part, is characterized in that it comprises, on either side of the longitudinal guiding rib and at least in the area where a shoe bears on the ski, an auxiliary separate profile fixed to the side face of the longitudinal guiding rib and lower than said rib, the separate auxiliary profile presenting a horizontal top surface on which bears the shoe sole.

The separate auxiliary profiles make it possible, due to a judicious choice of their material and shape, easily to modify the characteristics of a cross-country ski with longitudinal guiding rib, particularly concerning its suppleness and its response to stresses.

BRIEF DESCRIPTION OF THE DRAWINGS

Various embodiments of the present invention will be described hereinafter by way of non-limiting examples, with reference to the accompanying drawing, in which.

DETAILED DESCRIPTION OF THE PREFERRED EMBODIMENTS

Figures 1, 2, 3, 4:
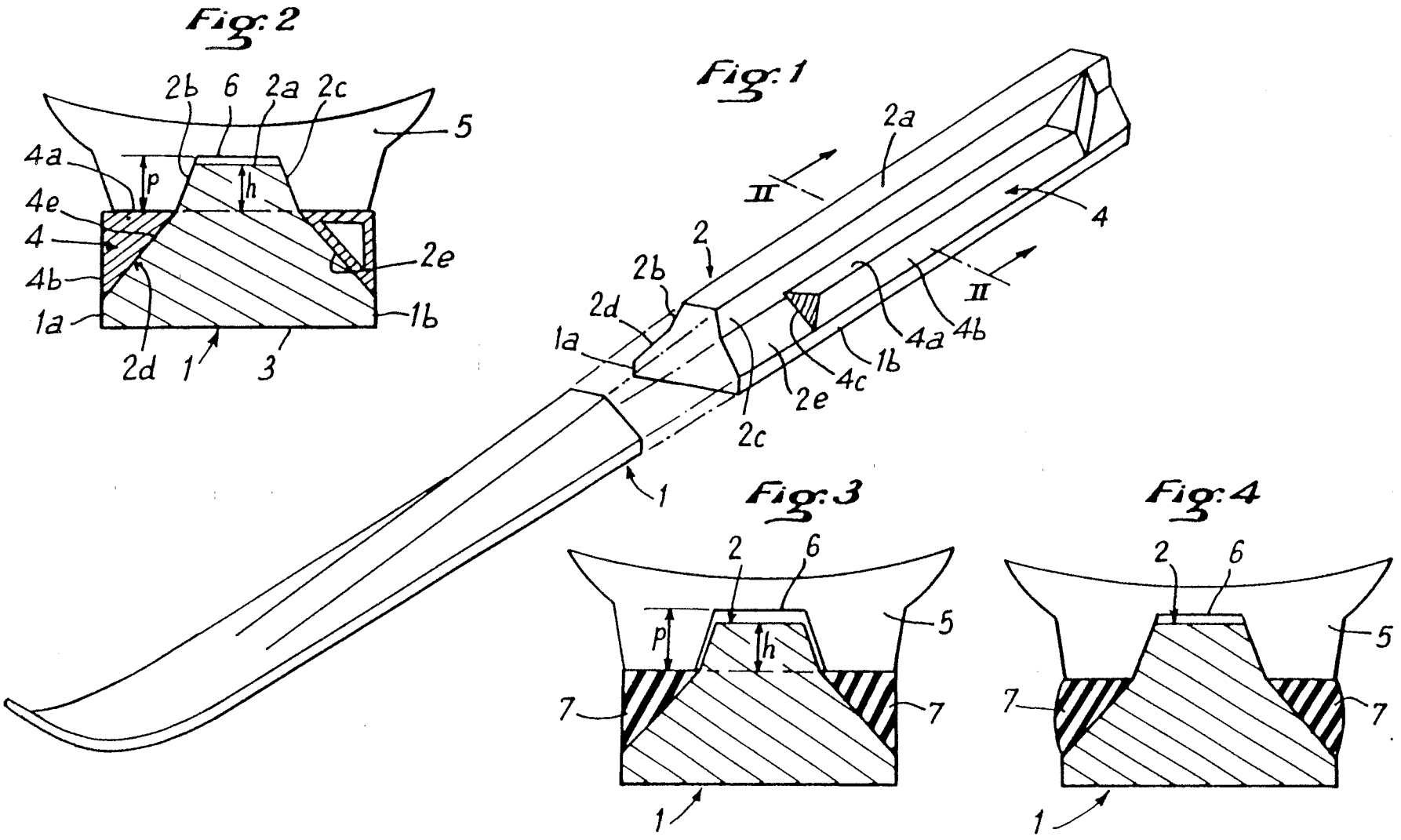
FIG. 1 is a partial view in perspective of a cross-country ski with longitudinal guiding rib on each side of which is fixed a separate auxiliary profile.
FIG. 2 is a view in vertical and transverse section, on a larger scale, made along line II—II of FIG. 1.
FIGS. 3 and 4 are views in vertical and transverse section of a cross-country ski of which the longitudinal guiding rib is flanked, on either side, by a separate elastic auxiliary profile.

FIGS. 1 and 2 show a cross-country ski 1 which presents, in its top part, a longitudinal guiding rib 2 of trapezoidal cross section. However, this trapezoidal cross section is not limiting and it may present any other appropriate form, particularly polygonal or curved. In the embodiment shown in FIGS. 1 and 2, the cross section of the rib 2 is constituted by the superposition of two elementary sections in the form of isosceles trapezoid. The guiding rib 2 thus presents a horizontal top face 2*a* constituting the small base of the upper trapezoidal section, which is extended by two inclined lateral faces 2*b*, 2*c*. This upper trapezoidal section joins a lower trapezoidal section of which the upper small base corresponds to the large base of the upper trapezoidal section. The lower trapezoidal section comprises two lower inclined lateral walls 2*d*, 2*e* which are less inclined than the upper inclined lateral walls 2*b*, 2*c*. The two lower inclined lateral walls 2*d*, 2*e* join the vertical edges 1*a*, 1*b*, of small height, of the ski 1 which extend up to the sole 3 of this ski.

According to the invention, the cross-country ski 1 is provided, on either side of the longitudinal guiding rib 2, with a separate auxiliary profile 4, non-unitary with the rib 1 which is rigid in the case of the embodiment shown in FIGS. 1 and 2. This profile is fixed on the inclined lateral faces 2*d*, 2*c* of the rib 2 by any appropriate means, for example by gluing. The profile 4 presents a cross section in the form of a right-angled triangle and it comprises a horizontal top face 4*a*, a vertical outer face 4*b* and an inclined inner face 4*c* corresponding to the hypotenuse of the right-angled triangle. The triangular cross section of the separate auxiliary profile 4 is such that its vertical outer face 4*b* lies in the plane of the edge 1*a*, 1*b* of the ski, that its inclined inner face 4*c* is applied on one of the lower inclined faces 2*d*, 2*e* of the rib 2 and that its top horizontal face 4*a* lies in the horizontal plane constituting the plane of separation of the two trapezoidal sections of the rib 2.

The separate rigid auxiliary profile 4 may be solid, as shown in the left-hand part of FIG. 2, or hollow as shown in the right-hand part of this Figure, on condition that, in the latter case, the wall of the profile is sufficiently thick to ensure the desired rigidity. The provision, on either side of the guiding rib 2, of separate rigid auxiliary profiles 4 makes it possible to modify as desired the overall characteristic of rigidity or of elasticity of the cross-country ski 1, depending on the desiderata.

FIG. 2 also shows the sole 5 of a ski shoe which is provided, in its lower face, with a longitudinal groove 6 capping the guiding rib 2. This sole 5 bears on the top horizontal faces 4*a* of the separate rigid auxiliary profiles 4 and the bottom of the groove 6 lies a little above the top face 2*a* of the rib 2, since the depth p of this groove 6 is slightly greater than the height h of the upper trapezoidal section 2*a*, 2*b*, 2*c* of the rib 2.

In the variant embodiment of the invention shown in FIGS. 3 and 4, the cross-country ski 1 bears, on either side of the longitudinal guiding rib 2, a separate auxiliary profile 7 made of supple and elastic material, for example rubber. Consequently, when the skier exerts a high pressure on his ski, at the moment of bearing on the ground, the elastic material of each separate auxiliary profile 7 is compressed by the sole 5 of the ski shoe, as is shown in FIG. 4. Such compression is rendered possible since the depth p of the groove 6 of the sole 5 is greater than the height h of the upper trapezoidal section 2*a*, 2*b*, 2*c* of the rib 2, so that the sole 6 may lower with respect to this rib, compressing the two separate auxiliary profiles 7. Such compression is therefore then translated, when the skier relaxes his pressure on the ski at the beginning of the advance stroke of this ski, by an elastic return of the material of the profile 7 to the relaxed state which thus contributes to the action of the skier's foot.

Figure 5:
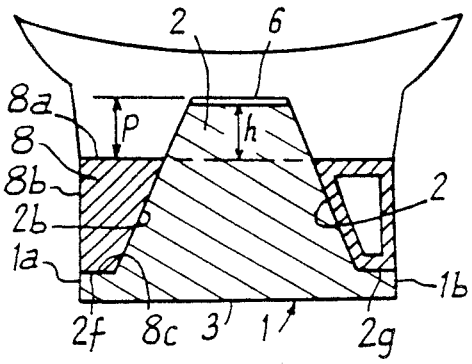
FIGS. 5 to 8 are views in vertical and transverse section of various variant embodiments.

In the variant embodiment of the invention shown in FIG. 5, the longitudinal guiding rib 2 has a cross section presenting the form of a single isosceles trapezoid. In other words, the inclined lateral faces 2*b*, 2*c* extend downwardly, with the same inclination, as far as a short distance from the sole 3, and at that spot, they are joined to horizontal flanges 2*f*, 2*g* of small width, which extend outwardly as far as the edges 1*a*, 1*b*. Consequently, each separate auxiliary profile 8 presents a cross section in the form of a right-angled trapezoid defined by a horizontal top face 8*a*, a vertical outer face 8*b* lying in the vertical plane of the edges 1*a*, 1*b*, a horizontal lower face 8*c* in contact with the lower horizontal flange 2*f*, 2*g* and of the same width thereas, and an inclined inner face 8*d*, with the same inclination as the inclined lateral faces 2*b*, 2*c* of the rib 2, and in contact with the lower part of these faces. Each profile 8 is shown as being rigid in FIG. 5 and it may either be solid (left-hand part of FIG. 5), or hollow (right-hand part of FIG. 5).

Figure 6:
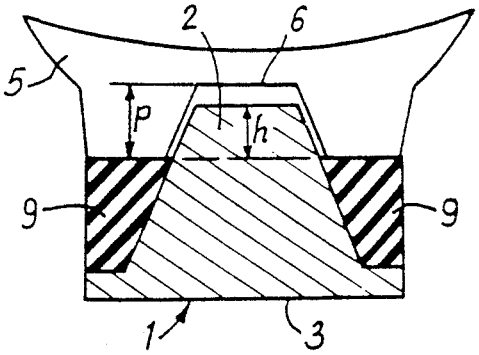
Figure 7:
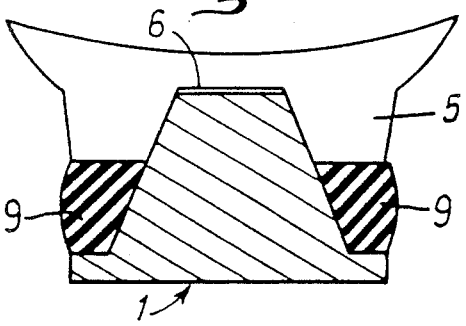

FIGS. 6 and 7 show a variant embodiment in which the separate auxiliary profiles 9 have the same trapezoidal cross section as the profiles 8 but are made of a supple and elastic material, which allows their compression by the sole 5 of the shoe as shown in FIG. 7.

Figure 8:
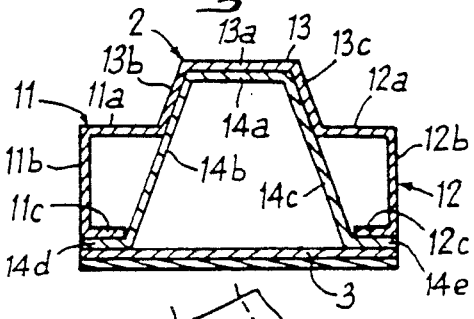

In the variant embodiment of the invention shown in FIG. 8, the cross-country ski comprises two separate auxiliary profiles 11, 12 of trapezoidal cross section, which are disposed on either side of the longitudinal guiding rib and are connected to each other. More particularly, the two separate auxiliary profiles 11, 12 constitute the end lateral parts of one and the same profile which comprises a top central part 13 of trapezoidal form, widening downwardly, which covers the top part of an inner profile 14 of likewise trapezoidal cross section, widening downwardly and joining the sole 3 of the ski. The two lateral profiles 11, 12 respectively comprise top horizontal faces 11*a*, 12*a* which join outer vertical faces 11*b*, 12*b* constituting the edges of the ski and which terminate in lower horizontal flanges 11*c*, 12*c* extending inwardly. The top trapezoidal central part 13 itself comprises a top horizontal face 13*a* and two inclined lateral faces 13*b*, 13*c* which respectively join the top horizontal faces 11*a*, 12*a* of the two lateral profiles 11, 12.

The inner profile 14 of trapezoidal cross section comprises a top horizontal face 14*a* on which is applied the top horizontal face 13*a* of the trapezoidal top central part 13, and two inclined lateral faces 14*b*, 14*c* on the upper parts of which are applied the inclined lateral faces 13*b*, 13*c* of the trapezoidal top central part 13. These lateral inclined faces 14*b*, 14*c* terminate, at their lower ends, in flanges 14*d*, 14*e*, extending outwardly and on which are applied the inner lower flanges 11*c*, 12*c* of profiles 11, 12. The volumes defined within the ski may be left empty or, on the contrary, they may be filled with a rigid, but light, material such as a foam.

Figure 9:
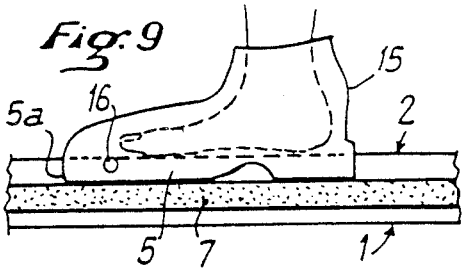
FIGS. 9 to 12 are schematic views in elevation illustrating the effect of elastic return ensured by each separate auxiliary profile.
Figure 10:
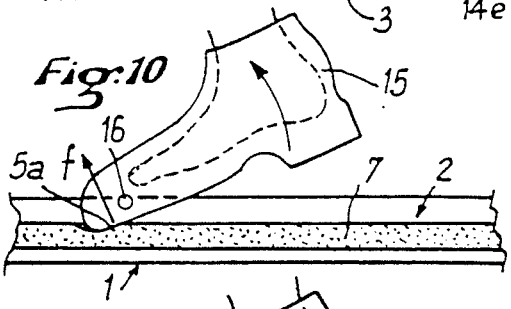

FIGS. 9 and 10 illustrate the manner in which an elastic separate auxiliary profile, such as profile 7, yields and reacts when a ski shoe 15, which is articulated, with respect to the cross-country ski 1, about a horizontal and transverse axis 16, pivots about this axis, by raising the heel at the moment of bearing on the ski for advancing the other ski. FIGS. 9 and 10 show that the end 5*a* of the sole 5 penetrates slightly in the elastic separate auxiliary profile 7, during pivoting of the shoe 15 in anti-clockwise direction about axis 16, and that the elastic deformation of the profile 7 is translated by a return effort f tending to return the shoe 15 into horizontal position on the ski.

Figure 11:
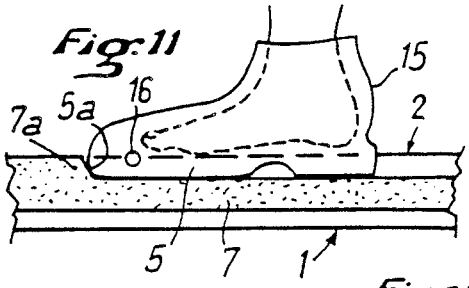
Figure 12:
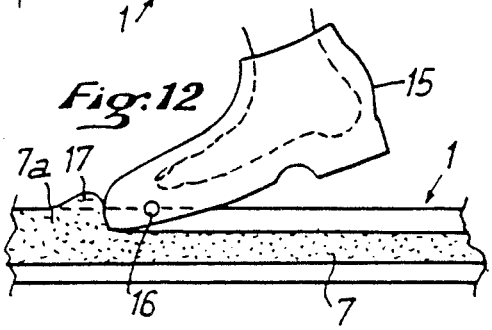

In the variant embodiment of the invention shown in FIGS. 11 and 12, the front part 5*a* of the sole 5 of the shoe is in abutment against an inclined face of a surelevated part 7*a* of the elastic separate auxiliary profile 7. Consequently, the movement of pivoting of the shoe 15, in anti-clockwise direction about the transverse axis 16, is translated by the penetration, by the end of the sole 5*a*, of the inclined face of the elastic surelevated part 7*a* which forms a slight bead 17, considerably exaggerated in FIG. 12, projecting with respect to the top surface, this bead 17 contributing to the elastic return of the shoe flat on the ski.

Figure 13:
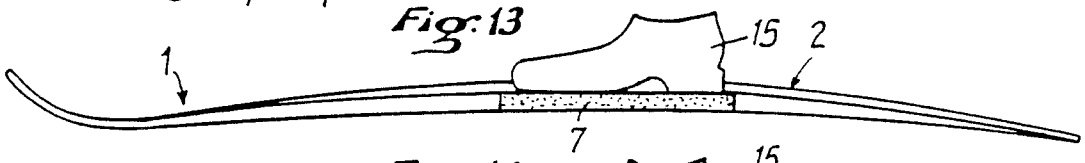
FIG. 13 is a schematic view in elevation illustrating a cross-country ski in which the separate auxiliary profile extends solely under the ski shoe.
Figure 14:
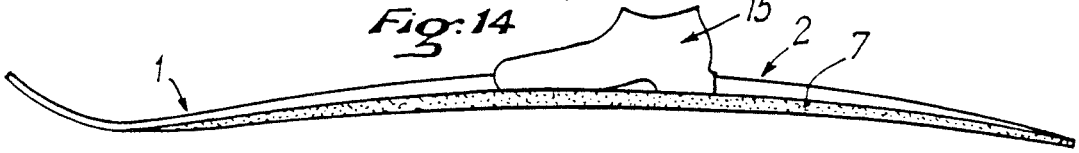
FIG. 14 is a schematic view in elevation of a cross-country ski in which the separate auxiliary profile extends virtually over the whole length of the ski.

As may be seen in FIGS. 13 and 14, the separate auxiliary profile, whether it be elastic or rigid, may extend solely under the shoe 15 (FIG. 13), or virtually over the whole length of the cross-country ski 1 (FIG. 14), or over only part of this length.

In all the embodiments of the invention which have been described hereinabove, the two separate auxiliary profiles located respectively on the two sides of the longitudinal guiding rib 2, may be of the same type or possibly of different types, for example rigid on one side of the rib 2 and supple and elastic on the other.

We claim:

1. A cross-country ski comprising:

an upwardly projecting, longitudinally extending rib, said rib having an upper surface and at least a pair of side surfaces;

at least two profiles, non-unitary with respect to said rib, affixed to respective ones of said pair of said side surfaces of said rib, each of said profiles comprising an upper surface and being positioned on said ski for supporting at least a portion of the sole of a ski shoe on said upper profile surface, wherein each of said side surfaces of said rib is inclined, and wherein each of said profiles further comprises an inner surface which is affixed to respective ones of said inclined surfaces of said rib, and wherein said upper surface of said rib projects upwardly beyond said upper surface of said profiles.

2. The ski of claim 1, wherein said ski further comprises a pair of edge surfaces, wherein said inclined side surfaces of said rib directly join said edge surfaces of said ski, and wherein each of said profiles has a transverse cross-section in the form of a right triangle whose hypotenuse corresponds to respective inner surfaces of said profiles.

3. The ski of claim 1, wherein said ski further comprises a pair of edge surfaces and a pair of lower flange surfaces connected thereto which extend inwardly and directly join respective ones of said inclined side surfaces of said rib, and wherein each of said profiles has a transverse cross-section in the form of a right angle trapezoid, a base of which corresponds to a lower surface of said profile, said lower profile surface resting upon a respective one of said flange surfaces.

4. The ski of claim 1, wherein each of said profiles is made of a rigid material.

5. The ski of claim 1, wherein each of said profiles is made of a supple and elastic material.

6. The ski of claim 1, wherein each of said profiles is solid.

7. The ski of claim 1, wherein each of said profiles is hollow.

8. The ski of claim 1, wherein said upper surfaces of said profiles extend longitudinally solely in a shoe supporting area.

9. The ski of claim 1, wherein said profiles extend longitudinally over a length of said ski which is greater than an area for supporting the sole of the ski shoe.

10. The ski of claim 1, wherein said ski further comprises a pair of edge surfaces lying in respective planes, and wherein each of said profiles comprises an outer surface which lies in a respective one of said planes of said edge surfaces.

11. The ski of claim 10, wherein said edge surfaces of said ski and said outer surfaces of said profiles lie in generally vertical planes.

12. The ski of claim 1, wherein said two profiles are joined together.

13. The ski of claim 1, wherein said two profiles are joined together by an upper central part having a generally trapezoidal configuration is transverse cross-section, widening downwardly, which covers said rib.

14. The ski of claim 13, wherein said two profiles comprise a portion of an outer profile, wherein said ski comprises a sole and a hollow inner profile having a generally trapezoidal transverse cross-section, wherein said inner profile extends upwardly from said sole to form said rib.

15. The ski of claim 14, wherein said outer profile comprises a pair of upper generally horizontal surfaces joined to respective outer generally vertical surfaces, constituting respective edges of said ski, a pair of inwardly extending generally horizontal flanges, wherein said upper central part comprises an upper generally horizontal surface of said outer profile and a pair of outwardly extending inclined lateral surfaces connected by said upper generally horizontal surface of said outer profile, said inclined lateral surfaces being directly connected to respective ones of said upper generally horizontal surfaces of said outer profile, and wherein said inner profile is hollow and comprises an upper generally horizontal surface affixed against said upper central part of said outer profile, said inner profile further comprising a pair of outwardly extending inclined lateral surfaces extending downwardly from said upper generally horizontal surface of said inner profile, at least respective upper portions of said outwardly extending inclined lateral surfaces of said inner profile being positioned adjacent respective ones of said outwardly extending inclined lateral surfaces of said outer profile, said outwardly extending inclined lateral surfaces of said inner profile terminating in outwardly extending flanges which are positioned adjacent respective ones of said inwardly extending generally horizontal flanges of said outer profile.

16. A cross-country ski comprising:

an upwardly projecting, longitudinally extending rib, said rib having an upper surface and a pair of side surfaces inclined with respect to said upper surface;

at least two profiles affixed to respective ones of said pair of inclined side surfaces of said rib, each of said profiles having an upper dimension wider in transverse cross-section than a lower dimension and further comprising a generally horizontal upper surface, said profiles being positioned on said ski to support at least a portion of the sole of a ski shoe, wherein said rib projects upwardly above each of said upper surfaces of said profiles.

17. The ski of claim 16, wherein each of said profiles have a generally triangular transverse cross-section.

* * * * *